United States Patent [19]

McCabe

[11] 4,213,365

[45] * Jul. 22, 1980

[54] PRESS

[76] Inventor: Francis J. McCabe, 239 Hastings Ct., Doylestown, Pa. 18901

[ * ] Notice: The portion of the term of this patent subsequent to Mar. 28, 1995, has been disclaimed.

[21] Appl. No.: 887,258

[22] Filed: Mar. 16, 1978

Related U.S. Application Data

[63] Continuation of Ser. No. 736,823, Oct. 29, 1976, Pat. No. 4,080,860, which is a continuation-in-part of Ser. No. 650,926, Jan. 21, 1976, Pat. No. 4,004,480.

[51] Int. Cl.[2] ..... B26D 5/12

[52] U.S. Cl. ..... 83/530; 83/604; 83/606; 83/634; 83/639; 100/270; 100/272

[58] Field of Search ..... 83/601, 627, 639, 530; 100/270, 272

[56] References Cited

U.S. PATENT DOCUMENTS

| | | | |
|---|---|---|---|
| 4,004,480 | 1/1977 | McCabe | 83/639 X |
| 4,080,860 | 3/1978 | McCabe | 83/639 X |

*Primary Examiner*—Willie G. Abercrombie

*Attorney, Agent, or Firm*—Benasutti Associates, Ltd.

[57] ABSTRACT

A fluid piston actuated press is provided with a fixed portion, such as a die, and a plurality of movable portions, such as punches, which move reciprocally along paths which intersect the fixed portion. A plurality of levers, actuated by an actuating means, engage the movable portions to cause them to move along their paths intersecting the fixed portion.

15 Claims, 7 Drawing Figures

PRESS

RELATED APPLICATIONS

The present invention is a continuation of Ser. No. 736,823, filed Oct. 29, 1976, and now U.S. Pat. No. 4,080,860, which application is a continuation-in-part of Ser. No. 650,926, filed on Jan. 21, 1976, and now U.S. Pat. No. 4,004,480.

These patents are specifically incorporated by reference as if fully set forth herein.

BACKGROUND OF THE INVENTION

This invention relates to presses, and more particularly, to pneumatic presses. In the prior art, presses actuated by various means, including pneumatic pistons and cylinders, have utilized punch and die sets to perform work on a work piece. Pneumatically actuated presses have generally been limited to light duty work even though it has been desirable to use pneumatic presses in other than light duty work, since the known pneumatic systems are limited in capacity. Some examples of prior art presses are illustrated in U.S. Pat. Nos. 1,038,934, 1,488,562, 2,241,794 and 3,230,812.

More recently, in patent application Ser. No. 650,926, filed Jan. 21, 1976, now U.S. Pat. No. 4,004,480, and in U.S. Pat. No. 3,690,207, I have described fluid piston actuated presses which have overcome many of the disadvantages of prior art.

SUMMARY OF THE INVENTION

I have invented a new improved press which is capable of simultaneously or sequentially moving a plurality of movable portions, such as punches, to intersect a single fixed portion, such as a die. These movable portions are caused to move by a plurality of levers, at least one for each movable portion, which may be actuated by a single actuating means as, for example, a double-acting cylinder. The actuating means may be adjustably engaged along the lengths of the levers to control the distance of travel of the movable portions and to control the force exerted by the lever on the movable portions in response to any given actuating stroke.

In alternate embodiments, I have also invented a new means for transmitting pneumatic power from a pneumatic piston and cylinder to the operating parts of a press. This new means generally comprises a lever means in which a novel fulcrum bearing is provided which is designed to reciprocate along an axis which acutely intersects the axis which is travelled by the punch portion of the press. By inclining the axis of travel of this novel fulcrum bearing means with respect to the stroke path, frictional forces which would otherwise be exerted on the punch to create a shearing action are eliminated, thereby ensuring that, in practice, those forces actually applied to the punch portion of the press are coincident with its path of travel.

Accordingly, primary objects of the invention are to provide a small, low-cost, reliable, and safe press whereby a plurality of movable portions may be actuated by a single actuating means.

Another object of the present invention is to provide a press with a single actuating means which may drive a plurality of movable portions either simultaneously or sequentially.

Another object of the present invention is to provide a press which may drive a plurality of movable portions along transverse or perpendicular paths.

Primary objects of alternate embodiments and features of the present invention are also the elimination of any shearing forces created by friction within the amplification means of a press and the provision of a compact press which provides easy accessibility to the working area. Another aim of the present invention is the provision of a press utilizing a fixed stroke pneumatic piston which is easily adjustable to a variety of forces and strokes. Another object of the present invention is the provision of the multiple piston press in which movable punch portions reciprocate transversely with respect to each other.

These and other objects of the present invention will become apparent from the following description with reference to the accompanying drawings.

DESCRIPTION OF THE PREFERRED EMBODIMENTS

Figure 1:
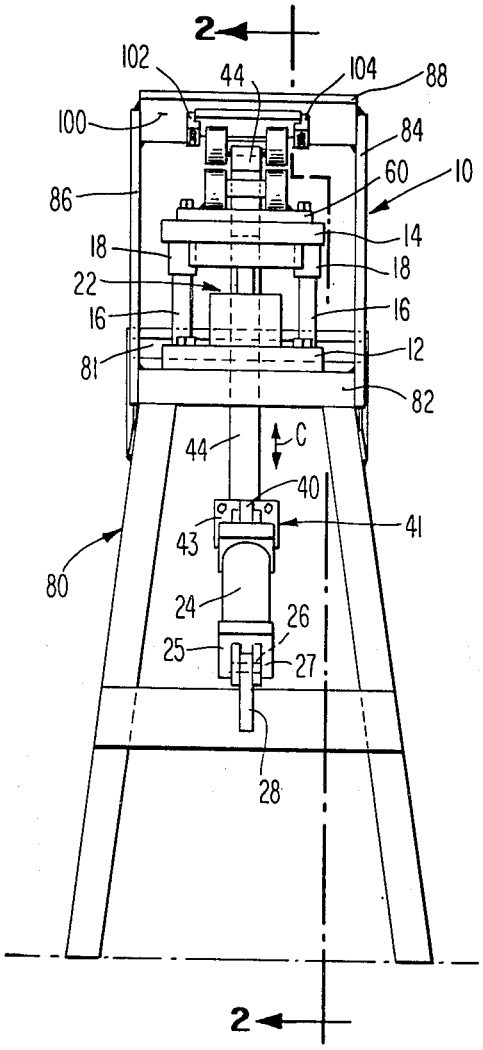
FIG. 1 is a front elevation of a pneumatic press in accordance with the preferred embodiment of my invention.

Although specific forms of the invention have been selected for illustration in the drawings, the following description is drawn in specific terms for the purpose of describing these forms of the invention, this description is not intended to limit the scope of the invention which is defined in the appended claims.

Figure 2:
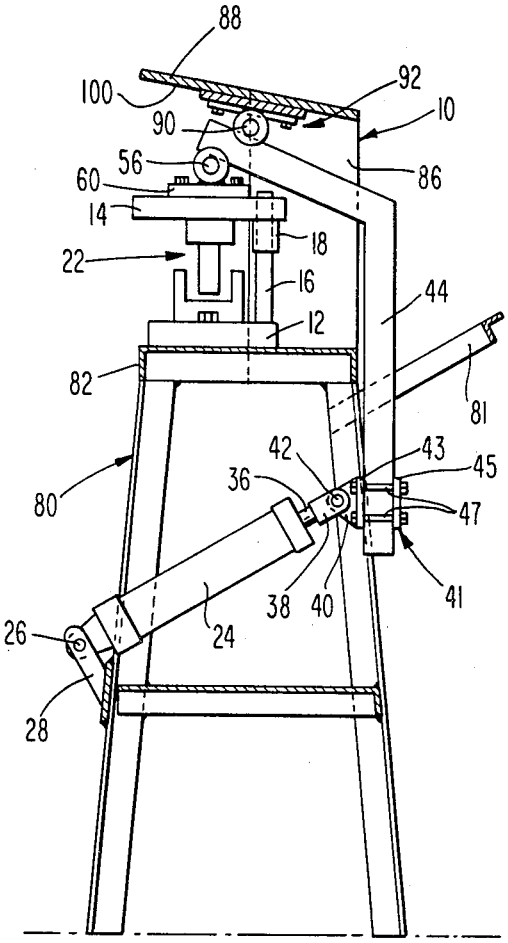
FIG. 2 is a section taken as indicated by the lines and arrows 2—2 in FIG. 1, showing a portion of the apparatus partially broken away.

Referring to the figures, FIGS. 1 and 2 show a preferred embodiment of the present invention wherein cylinder 24 is mounted under the punch and die set designated generally 22 with an open area defined by a stand designated generally 80. The frame 10 of the press is deemed to generally comprise this stand, designated generally 80, on which is disposed mounting plate 82 which, in FIG. 2, is show to have a U-shaped cross section. Supporting plates 84 and 86 extend generally perpendicularly away from mounting plate 82 to support fulcrum plate 88, which is a substantially planar plate disposed in a plane which forms an acute angle wth respect to the face of mounting plate 82. The purpose and precise nature of this angular mounting of the fulcrum plate 88 will be discussed more fully hereinafter. As seen particularly in FIG. 1, the fulcrum plate 88 has a smooth planar undersurface 100, the function of which will also be more fully explained hereinafter. The stand 80 and the frame 10 are constructed from conventional materials of sufficient strength to withstand the forces exerted upon them during the operation of the press.

As seen in FIGS. 1 and 2, a base portion 12 is rigidly mounted on the mounting plate 82 and a movable portion 14 cooperates with guide means 16 and 18 which cooperate therewith in guiding the movable member 14 towards the fixed base member 12 and in returning the movable member to its original position. Between the fixed and movable members, a punch and die set designated generally 22 is mounted. The specifies of this die set are not illustrated in further detail herein since they are well known in the art and form no part of this invention.

The actuating means engages each of the levers for exerting forces on the levers to cause the movable portions to selectively move along their respective paths. Here the actuating means for the press is depicted as a double-acting pneumatic piston and cylinder arrangement comprising a cylinder 24 pivotally mounted at one end to a portion of the stand designated generally 80 by any suitable means such as a shaft 26 fixedly attached thereto and passing through cylinder flanges 25 and 27 and anchor member 28 which is rigidly affixed to the stand designated generally 80. Connected to the piston (not shown) within the cylinder and extending therefrom is piston rod 36. The rod terminates in a yoke 38 which is pivotally connected to the ear 40 by the shaft 42 passing therethrough. The piston, cylinder and piston rod arrangement forming the pneumatic means are well known in the art, and upon appropriate air input function to drive the piston rod and extend or retract it with respect to the cylinder.

Together, ear 40, ear mounting plate 43, compression plate 45 and bolts 47 comprise the adjustable bracket means designated generally 41 of the present invention. When the bolts 47 are loosened the remainder of the adjustable bracket means may be slid along lever arm 44 to vary the point on that lever arm at which the force from cylinder 24 is applied. This adjustable path of travel of the bracket means designated generally 41 is illustrated by arrow C shown in FIG. 1 by moving the bracket means relatively closer to the middle of the lever arm 44, the length of stroke of the movable upper portion 14 is increased while the power of the stroke is proportionally decreased. Similarly, as the adjustable bracket means designated generally 41 is fastened relatively near the end of lever arm 44, the length of stroke of the upper movable portion 14 will be decreased with a proportional increase in the power of that stroke. As a result, a pneumatic cylinder having a fixed stroke of fixed power is easily adapted to power a press wherein the power and length of stroke is easily adjusted.

Figure 3:
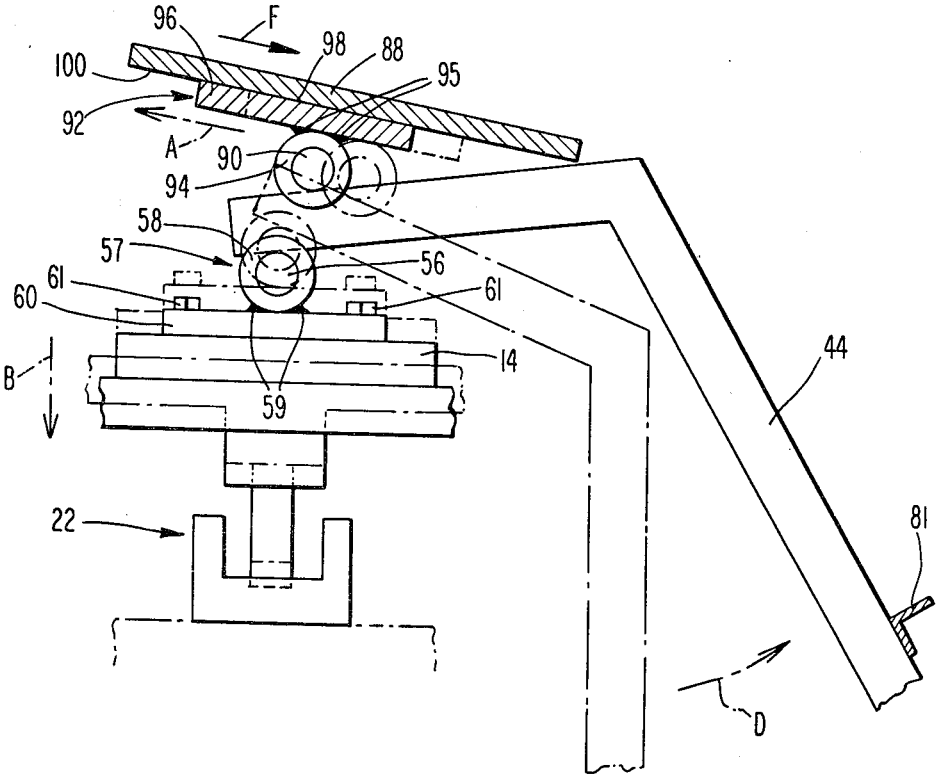
FIG. 3 is an enlarged side view of a portion of the apparatus shown in FIG. 2 with alternate positions shown in phantom.

Referring now to FIG. 3, which is an enlarged side view of a portion of the press shown in FIG. 2, the upper movable portion 14 is shown in combination with its associated punch and die set designated generally 22. During activation of the press the desired power stroke of the upper movable portion 14 and its associated punch is along an axis as illustrated by arrow B in FIG. 3. Theoretically, a lever without any bearing means whatsoever could be used in order to produce a suitable power stroke. In actuality, however, upon the activation of a lever to produce a power stroke of the movable portion of a press, frictional forces are created which lend to that movable portion a shearing component, that is to say, a force is applied upon the movable portion of the press which has a vector component which is transverse to the power stroke vector component of that force. As illustrated in FIG. 3, however, applicant's invention counteracts shearing forces by supplying a means to counteract and thereby neutralize the shearing force. This means for counteracting the frictionally induced shearing forces may be best described in connection with the operation of the press shown in FIG. 3. Upon activation of the pneumatic cylinder (not shown in FIG. 3) lever arm 44 is caused to move from its position as shown in phantom in FIG. 3 along an arc as illustrated by arrow D in FIG. 3 until either the stop bracket prevents further movement or until the cylinder shaft is fully extended. Stop bracket 81 is adjustable with respect to frame 80 not only to provide a means for adjusting the power stroke of the press by varying the degree of arc D shown in FIG. 3, but also for the purpose of allowing the stop bracket 81 to be oriented to intersect the power stroke axis of piston rod 36. By adjusting the stop bracket 81 to intersect with the power stroke axis of piston rod 36, the force applied by cylinder 24 may be limited without created additional torques which might otherwise be translated to the punch and die assembly designated generally 22. The thrust bearing member designated generally 57 is shown in FIG. 3 to move along an axis parallel to the axis defined by arrow B in FIG. 3 from the phantom to the lined position shown in FIG. 3. During its advancement thrust bearing surface 56, which is welded to lever arm 44, rotates within the thrust cradle 58. This thrust cradle is a substantially tubular member which concentrically engages the thrust bearing surface 56. A portion of the thrust cradle member 58 is cut away along its upper surface as seen in FIG. 3 to enable interconnection between the thrust bearing member 56 and the lever arm 44 and to further facilitate rotation of the thrust bearing surface within the thrust cradle member. The thrust cradle member 58 is welded by weld 59 to thrust block 60, which is a substantially planar plate which is bolted by bolts 61 to the upper movable member 14. As a result, the thrust bearing means designated generally 57 is seen to pivotally connect the lever arm 44 with the upper movable portion 14 so that the thrust of lever arm 44 is transferred thereto.

A fulcrum bearing surface 90 is shown in FIG. 3 welded to lever arm 44. This bearing surface comprises a shaft which is encircled on its ends by fulcrum cradle means 94 which is substantially tubular with the exception of a suitable portion which is cut away to allow the interconnection between the fulcrum bearing surface 90 and lever arm 44. The fulcrum cradle means 94 is welded to fulcrum block 96 by welds 95. The fulcrum block 96 is a substantially planar plate having a flat surface 98 thereon which engages the flat undersurface 100 of fulcrum plate 88. Fulcrum block 96 is allowed to slide along the undersurface 100 of the fulcrum plate in an axis which is defined by tracks 102 and 104 as seen in FIGS. 1 and 2. Upon activation of the pneumatic cylinder to cause the lever arm 44 to move from the phantom to the line position in FIG. 3, the fulcrum bearing means designated generally 92 for engaging the bearing surface allows the bearing surface 90 to rotate within the fulcrum cradle 94 and further allows the fulcrum bearing surface 90 to move along an axis as indicated by arrow A in FIG. 3. Normally, the movement of fulcrum block 96 across fulcrum plate 88 would give rise to a frictional force which can be conceptualized as a force resulting from the resistance of the plate to the block which is illustrated by arrow F in FIG. 3. By slightly tilting the fulcrum plate 88 and the fulcrum block 96 to an acute angle with respect to the axis of arrow B in FIG. 3, a vector component is created, tending to force the block in the direction along axis A as indicated in FIG. 3, which vector component has the effect of cancelling the frictional force F as shown in FIG. 3. As a result, the only remaining force is a force having a vector component parallel to axis B as indicated in FIG. 3, and the result is a punching action in which the shearing forces are minimized or eliminated.

The degree of tilt which is necessary in order to effectively counteract the shearing forces which are frictionally induced will, of course, vary in accordance with the severity of the frictional forces which are inherent in any particular machine construction. Under normal conditions, applicant has found that in most applications an acute angle of more than 70 and less than 90 degrees is sufficient to effectively counteract these frictionally induced shearing forces. More particularly, for a device as shown in FIGS. 1–3, applicant has found that an acute angle between 80 and 85 degrees is preferred to counteract these frictionally induced shearing forces. As used herein, the acute angle which is referred to throughout the specification and claims is that angle which is formed between the axis of reciprocation of the thrust bearing means designated generally 57 in FIG. 3 and the axis of reciprocation of the fulcrum bearing means designated generally 92 in FIG. 3, which angle is generally located between the fulcrum bearing surface 90 and the thrust bearing member designated generally 57.

Figure 4:
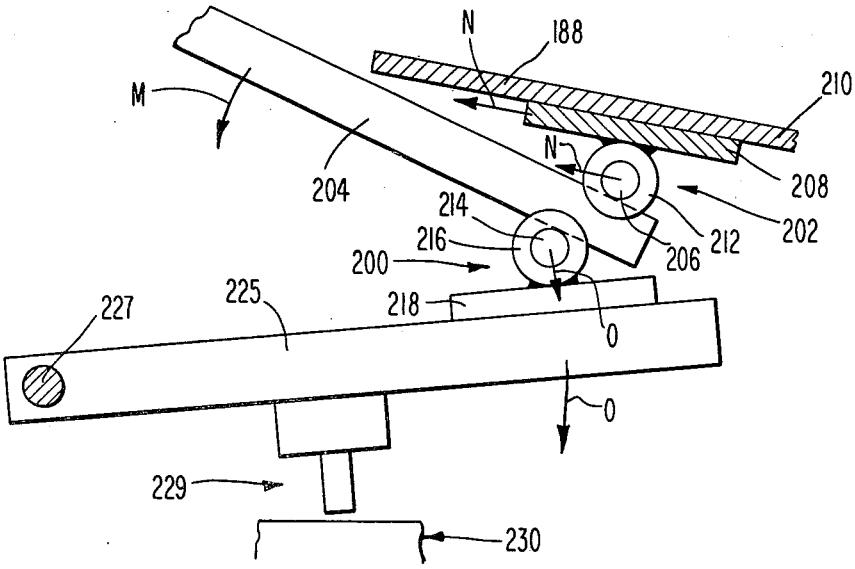
FIG. 4 is an enlarged side view of an alternate embodiment of the present invention illustrated in the form of a compound press.

Referring now to FIG. 4, which shows an alternate embodiment of the present invention in the form of a compound press, the invention is illustrated in a form wherein the thrust bearing means designated generally 200 is located intermediate along the lever arm 204 with respect to the fulcrum bearing means designated generally 202. Upon activation of the lever means 204 along an arc designated M in FIG. 4, the fulcrum bearing means for engaging fulcrum bearing surface 206 will slide generally to the left as seen in FIG. 4 along an arrow designated N in FIG. 4, as described above. The fulcrum block 208 will slide along fulcrum plate 210 while bearing surface 206 rotates within the fulcrum cradle means 212. The thrust bearing means will similarly be driven in a direction as indicated by the arrow O in FIG. 4 while the thrust bearing surface 214 rotates within thrust cradle means 216, which is welded to thrust block 218. As illustrated in FIG. 4, the movement of the thrust bearing means designated generally 200 is used to apply force to a second lever arm 225 which is mounted on a pivot 227 to move a punch 229 towards a die 230.

Figure 5:
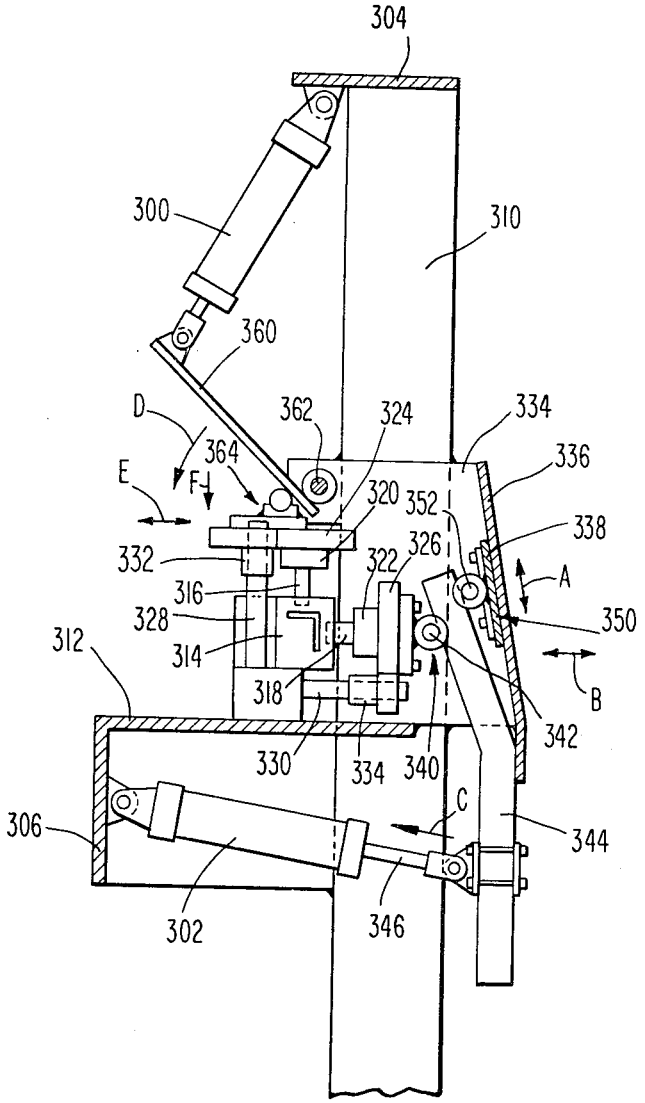
FIG. 5 is an enlarged side elevation of a second alternate embodiment press constructed in accordance with the present invention.

Referring now to FIG. 5, a press is shown in which two actuating cylinders 300 and 302 are mounted on mounting plates 304 and 306 respectively. These mounting plates are welded or otherwise attached to frame 310 and mounting plate 312 respectively. On mounting plate 312 is disposed a die 314 which is adapted to receive two punches 316 and 318 which act along axes which are substantially transverse to each other. These punches are mounted on suitable punch supports 320 and 322 which are in turn mounted on first and second movable portions 324 and 326. Guide rods 328 and 330 are journalled within bushings 332 and 334 to guide punches 316 and 318 along the desired axes. A substantially planar plate 335 is welded to frame 310 and coacts with a symmetrically disposed planar plate (not shown) to support fulcrum plate 336. As in the embodiments illustrated in FIGS. 1–4, the fulcrum plate 336 and fulcrum block 338 form an acute angle with respect to the axis of travel of punch 318 which angle is on the order of more than 70 and less than 90 degrees, and preferably is between 80 and 85 degrees, as measured by the smallest angle formed between the intersection of axes parallel to A and B as indicated in FIG. 5. As in the other embodiments, thrust bearing means designated generally 340 engages bearing surface 342, which is rigidly attached to lever arm 344 and which rotates within thrust bearing means 340. When cylinder 302 is activated to draw a shaft 346 in a direction as indicated by arrow C in FIG. 5, fulcrum bearing means designated generally 350 allows fulcrum bearing surface 352 which is welded to lever arm 344 to rotate within the fulcrum cradle and further causes the fulcrum bearing means designated generally 350 to move along an axis as indicated by arrow A in FIG. 5. As a result, frictionally induced shearing forces are counteracted so that only forces parallel to the axis indicated by arrow B in FIG. 5 are applied to punch 318. The second force amplification means shown in the embodiment of FIG. 5 is a pneumatic actuated lever amplification means similar to that described in my previously issued U.S. Pat. No. 3,690,207, wherein the thrust F from punch 316 is produced by actuation of cylinder 300 to cause lever 360 to move along an arc as designated by arrow D in FIG. 5. A fixed pivot 362 is rigidly attached to lever arm 360 while thrust bearing means designated generally 364 reciprocates along an axis E as designated in FIG. 5 along the upper surface of upper movable portion 324.

As a result, a press is provided which is extremely compact and which could, within the spirit of the present invention, incorporate further movable portions disposed along other intersecting axes for the purpose of sequentially forming extremely complex pieces. It will be noted, for example, that the particular design illustrated in FIG. 5 disposes both lever arm and cylinders within a single plane for action upon die 314. Subsequent modification, depending on the die, could easily substitute additional cylinders and lever arms to act on die 314 within a plane transverse to the plane of the paper. Applicant believes that this compactness and flexibility has never been achieved in the prior art and facilitates a variety of punch and die operations which are not feasible using other prior art presses.

Figure 6:
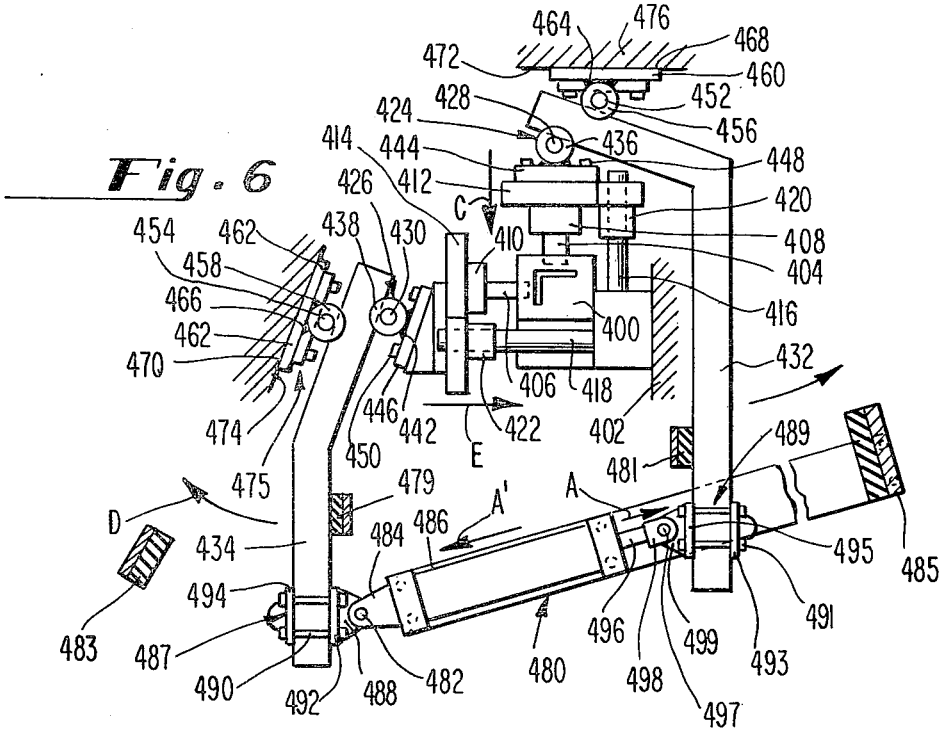
FIG. 6 is an enlarged side view of a third alternate embodiment of the present invention illustrated in the form of a multiple punch press actuated simultaneously by one power cylinder.
Figure 7:
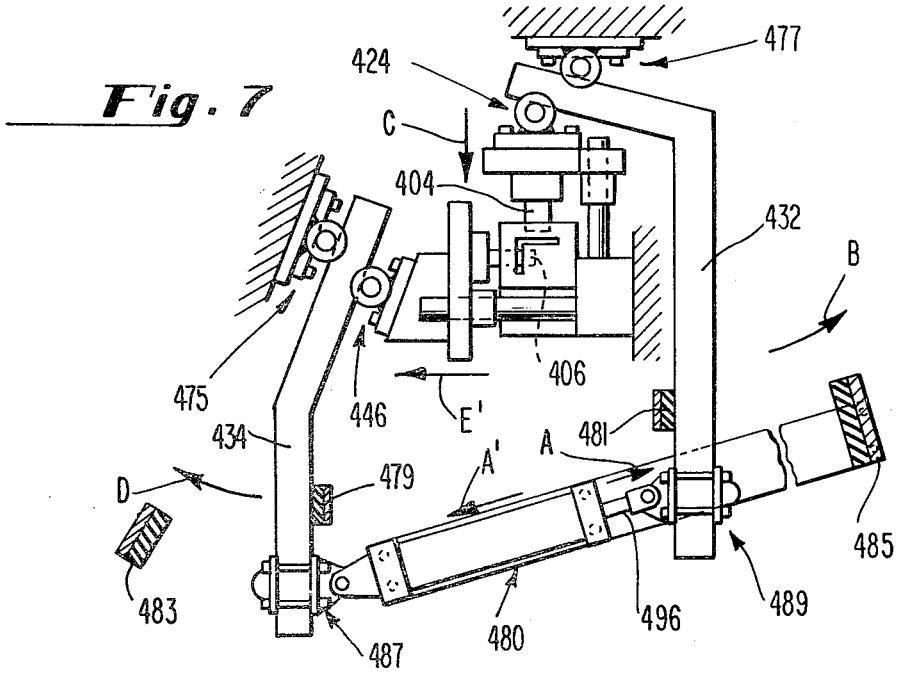
FIG. 7 is an enlarged side view of another embodiment similar to the embodiment shown in FIG. 6 whereby a multiple punch press is actuated sequentially by one power cylinder.

Referring now to another preferred embodiment, FIGS. 6 and 7 show an enlarged side view of a multiple punch press with a plurality of movable portions which are actuated either simultaneously or sequentially. In this embodiment, the apparatus shown may be mounted so that a cylinder may be mounted under the punch and die set as shown in FIGS. 1 and 2 attached at either end to a lever. Referring to FIGS. 1 and 2, the support plates 84 and 86, as well as the fulcrum plate 88 could be extended so as to mate with the fulcrum plane 478 of FIGS. 6 and 7. In this way, the multiple punch presses of FIGS. 6 and 7 may be incorporated into the press frames of FIGS. 1 and 2.

FIGS. 6 and 7 illustrate the action of a multiple punch press by a single actuating cylinder whereby the punches move in transverse or perpendicular paths.

Referring now to FIG. 6, a press is shown with a single fixed die 400 disposed on mounting plate 402 and adapted to receive two punches 404 and 406 which act along axes which are substantially transverse to each other. Similar punches are mounted on suitable punch supports 408 and 410, respectively, which are in turn mounted on first and second movable portions 412 and 414. Guide rods 416 and 418 are journalled within bushings 420 and 422, respectively, to guide punches 404 and 406 along the desired axes. As in other embodiments, thrust bearing means designated generally 424 and 426 engage bearing surfaces 428 and 430, respectively, which are rigidly attached to lever arms 432 and 434, respectively, and which rotates within the thrust cradles 436 and 438. The thrust cradles are substantially tubular members which concentrically engage the thrust bearing members 428 and 430 and the lever arms 432 and 434. The thrust cradle members 436 and 438 are welded by welds 440 and 442 to thrust blocks 444 and 446, respectively, which are substantially planar plates which are bolted by bolts 448 and 450 to the upper movable members 412 and 414. As a result, the thrust bearing means designated generally 424 and 426 are seen to pivotally connect the lever arms 432 and 434 with the upper movable portions 412 and 414 so that the thrust of the lever arms 432 and 434 is transferred thereto.

Fulcrum bearing surfaces 452 and 454 are welded to lever arms 432 and 434. These bearing surfaces comprise shafts which are encircled on their ends by fulcrum cradle means 456 and 458 which are substantially tubular with the exception of a suitable portion which is cut away to allow the interconnection between the fulcrum bearing surfaces 452 and 454 and lever arms 432 and 434, respectively. The fulcrum cradle means 456 and 458 are welded to fulcrum blocks 460 and 462, respectively, by welds 464 and 466. The fulcrum blocks 460 and 462 are substantially planar plates having a flat surface 468 and 470 thereon which engages the flat undersurface 472 and 474 of fulcrum planes 476 and 478. Fulcrum blocks 460 and 462 are allowed to slide along the under surfaces 472 and 474 of the fulcrum planes in a manner similar to that described for FIG. 3.

The actuating means for the press is a double-acting pneumatic piston and cylinder arrangement comprising a cylinder 480 pivotally mounted at one end to lever 434 by any suitable means such as a shaft 482 passing through cylinder flanges 484 and 486. An anchor member 488 which is rigidly affixed to lever 434 through the use of bolts 490 and ear mounting plate 492 and compression plate 494. Connected to the piston (not shown) within the cylinder and extending therefrom is piston rod 496. The rod terminates in a yoke 498 which is pivotally connected to the ear 499 by the shaft 497 passing therethrough. The ear 499 is connected to the ear mounting plate 495 which is bolted to the compression plate 493 thereby attaching the piston rod to the lever 432. Together, the ears 499 and 488, ear mounting plates 492 and 495, compression plates 493 and 494 and bolts 490 and 491 comprise the adjustable bracket means designated generally 487 and 489 of the present invention. When the bolts 490 or 491 are loosened, the remainder of the adjustable bracket means may be set along the lever arms 432 or 434 to vary the point on the lever arm at which the force from cylinder 480 is applied.

When the cylinder 480 is actuated, so as to expand, either of two things initially occur. The piston rod 496 may extend along the path designated by arrow A in FIG. 6 until the punch 404, following the path designated by the arrow C, stops the extension or the lever arm 432 following the arcuate path designated by the arrow B impacts the stop 485 or the piston rod 496 reaches the limit of its extension. The other movement which may occur is that the cylinder will move along the path designated by the arrow A' in FIG. 6 until the punch 406 prevents further movement or the lever arm 434 impacts stop 483 or the movement of the cylinder housing reaches the limit of its extension. Should the resistance to movement or friction of the punches 404 and 406 be about equal, then movement of the cylinder along the arcuate path designated by the arrow D and movement of the piston rod along the arcuate path designated by the arrow B will proceed simultaneously until operation of the punches themselves prevents further movement or until the lever arms 432 and 434 impact the adjustable stops 485 and 483, respectively. The adjustable bracket means 487 and 489 in FIG. 6, whose operation was described earlier, may be utilized to deliver more force to one punch than to another or to deliver a force sooner to one punch than to another, thereby resulting in a simultaneous punching operation by compensating for possible differences in the resistance to travel of the various punches or, alternatively resulting in a slight delay between the movement of the punches. When the cylinder is energized in a contractive mode, the lever arms 432 and 434 will move towards one another until retraction of the punches prevents further movement or until compression of the cylinder prevents further movement, or until the lever arms 432 and 434 impact adjustable stops 481 and 479, respectively.

Referring now to FIG. 7, a similar press arrangement as that show in FIG. 6 is provided. A single actuating means 480 is adjustably connected to lever arms 432 and 434 through the use of adjustable bracket means 487 and 489. The movement of the lever arm 432 is transmitted to a movement of the punch 404 along its axes as shown by arrow C through the use of the thrust bearing means 424 and fulcrum bearing means 477. However, unlike the case in FIG. 6, when the cylinder 480 is energized and the piston rod 496 extends along path A, the lever arm 434 now moves to withdraw punch 406 from the die as shown by the arrow E'. This occurs because of the shift in the relative positions of the thrust bearing means and the fulcrum bearing means 446 and 475 along the lever arm. 434. It should be noted that in FIG. 6, fulcrum bearing means denoted generally at 475, is interconnected to the lever arm 434 at a point intermediate the interconnection of the thrust bearing means denoted generally 446 and the adjustable bracket means denoted generally at 487, but in FIG. 7, the relative positions of the thrust bearing means 446 and the fulcrum bearing means 475 along the lever 434 have been interchanged so that now the thrust bearing means 446 is intermediate the interconnection of the fulcrum bearing means 475 with the lever 434 and the adjustable bracket means 487.

When the cylinder in FIG. 7, designated by 480, is attached, piston rod 496 will begin to move along the path designated by arrow A and the cylinder 480 will begin to move along the path designated by arrow A' until movement of the punches 404 along the path designated by the arrow C or movement of the punch 406 along the path designated by the arrow E' or maximum expansion of the piston rod prevents further movement, or until lever arm 432 moving along arcuate path B impacts adjustable stop 485 or lever arm 434 moving along the arcuate path D impacts adjustable stop 483. Unlike the movement in FIG. 6, the action of the punches toward the die is sequential, rather than simultaneous. When the cylinder is actuated in a contractive mode, the punch assemblies and lever arms will re-trace their paths until the movement of the punches prevent further motion or until lever arm 432 impacts adjustable punch 481 or lever arm 434 impacts adjustable stop 479, or until compression in the cylinder prevents further movement.

In addition to the advantages of the invention mentioned above, it will be noted that the embodiments of FIGS. 6 and 7 provide a flexible, multiple punch operation on a single, lightweight press resulting in more efficient operation. Another advantage is the safety aspect of multiple, heavy-duty press operations being powered by a single pneumatic cylinder drive by normal, factory compressed air sources. This is in contrast to other punch presses with top heavy operations driven by high pressure hydraulic or other power systems. Because of the lightweight character, flexibility by punch operations and requirement of only a normal factory compressed air power source, it will be seen that this invention provides a press which can readily be relocated within the factory confines where the need arises resulting in more efficient factory operations overall.

It will be understood that various changes in the details, materials and arrangement of parts which have been herein described and illustrated in order to explain the nature of this invention may be made by those skilled in the art within the principle and scope of the invention as expressed in the following claim.

It will further be understood that the "Abstract of the Disclosure" set forth above is intended to provide a non-legal technical statement of the contents of the disclosure in compliance with the Rules of Practice of the U.S. Patent and Trademark Office, and is not intended to limit the scope of the invention described and claimed herein.

What is claimed is:

1. A press comprising:

(a) a frame;

(b) at least one die member fixedly mounted on said frame;

(c) at least one lever and punch means adjacent said die member for moving toward and away from said die member; and (d) at least one actuating means operatively connected to said lever and punch means for exerting forces against and causing movement of said lever and punch means.

2. A press as claimed in claim 1, further comprising adjustment means connected between said actuating means and said lever and punch means for adjusting the relative position of said actuating means with respect to said lever and punch means.

3. A press as claimed in claim 1, wherein said lever and punch means is comprised of:

(a) at least one movable punch member, said punch member being adapted to move reciprocally along a path which intersects said die member; and (b) at least one lever member means operatively connected to said actuating means and engaging said punch member for selectively causing said punch member to move along said path intersecting said die member.

4. A press as claimed in claim 2, wherein said lever and punch means is comprised of:

(a) at least one movable punch member, said punch member being adapted to move reciprocally along a path which intersects said die member; and (b) at least one lever member means operatively connected to said actuating means and engaging said punch member for selectively causing said punch member to move along said path intersecting said die member.

5. A press as claimed in claim 4, wherein said adjustment means is connected to said actuating means and adjustably engages said lever member means along the length thereof, whereby the distance of travel of said punch member and the force exerted by said lever member means on said punch member vary with said adjustment of said actuating means.

6. A press as claimed in claim 3, wherein said punch member moves between first and second positions, said first position being within said die member and said second position being outside said die member.

7. A press as claimed in claim 3, wherein a plurality of die members, punch members, level member means and actuating members are provided.

8. The invention of claim 6 wherein the lever member means is mounted so that said punch member is in the first position when said actuating means is expanded and in the second position when said actuating means is contracted.

9. The invention of claim 3 wherein a fulcrum is located along said lever member means intermediate the point of engagement of said lever member means to said actuating means and the point of engagement of said lever member means with said punch member.

10. The invention of claim 6 wherein a fulcrum is located along a first lever member means intermediate the point of engagement of said first lever to a first actuating means and the point of engagement to said first lever with a first punch member and wherein the point of engagement of a second lever member means with a second punch member is intermediate the location of a fulcrum along said second lever member means and the point of engagement of said second lever member means to a second actuating means.

11. The invention of claim 3 wherein said press further comprises at least one adjustable stop means for limiting the movement of said lever member means.

12. The invention of claim 6 wherein said press further comprises a plurality of adjustable stop means for limiting the movement of a plurality of said lever member means.

13. The invention of claim 3 wherein said actuating means is adapted to simultaneously apply expansive forces to said lever member means.

14. The invention of claim 3 wherein said actuating means is adapted to simultaneously apply contractive forces to said lever member means.

15. The invention of claim 3 wherein said actuating means comprises a double-acting cylinder.

* * * * *